United States Patent [19]

Weisgerber

[11] Patent Number: 4,570,308

[45] Date of Patent: Feb. 18, 1986

[54] CONSTRUCTION FOR A BELT BUCKLE

[76] Inventor: Robert G. Weisgerber, R.D. #6, Box 2732, Mt. Pleasant, Pa. 15666

[21] Appl. No.: 590,265

[22] Filed: Mar. 16, 1984

[51] Int. Cl.[4] ..... A44B 11/00

[52] U.S. Cl. ..... 24/163 K; 24/163 R; 24/163 FC; 40/21 C; 224/163

[58] Field of Search ..... 24/163 K, 163 R, 163 FC, 24/645; 224/163; 40/21 C

[56] References Cited

U.S. PATENT DOCUMENTS

| | | | |
|---|---|---|---|
| 959,340 | 5/1910 | Hauser | 24/163 K |
| 1,127,895 | 2/1915 | Kahn | 40/21 C |
| 1,508,963 | 9/1924 | Dorf | 24/163 K |
| 1,878,792 | 9/1932 | Marinsky | 224/163 |
| 1,882,475 | 10/1932 | Blickhahn | 40/21 C |
| 3,969,836 | 7/1976 | Du Bois | 24/163 K |
| 4,052,773 | 10/1977 | Nesbitt | 24/163 K |
| 4,170,808 | 10/1979 | Knowles | 24/163 K |
| 4,177,587 | 12/1979 | Dorsen et al. | 40/21 C |
| 4,384,390 | 5/1983 | Hayakawa | 24/163 K |

FOREIGN PATENT DOCUMENTS

| | | | |
|---|---|---|---|
| 987045 | 8/1951 | France | 24/163 FC |
| 1375739 | 9/1964 | France | 24/163 FC |
| 786860 | 11/1957 | United Kingdom | 24/163 FC |
| 8002495 | 11/1980 | United Kingdom | 40/21 C |

*Primary Examiner*—Victor N. Sakran

*Attorney, Agent, or Firm*—H. Keith Hauger

[57] ABSTRACT

A belt buckle employing a front plate with a window and a removable rear covering which allows for the insertion of an item for its display in the window by the wearer.

4 Claims, 4 Drawing Figures

CONSTRUCTION FOR A BELT BUCKLE

BACKGROUND OF THE INVENTION

The present invention relates to a belt buckle that is designed to display a variety of items. More particularly, the invention relates to a belt buckle manufactured from a framework with an open viewing section, and an easily removable portion containing the item to be displayed.

An ideal item particularly intended for display in the belt buckle is what is referred to as conservation wildlife stamps. These are "Collector Series" stamps picturing various species of wildlife in their natural habitat and are miniature representations of larger prints taken from original art works by notable artists. Other "Collector Series" stamps may include a boating and sailing series which could be similarly displayed. Other items for display may be: relatively flat pieces of wood, metal, ceramic, ivory, leather, plastic, cloth, and paper including laser etched "scrimshaw" (carved articles); pressed metal figures; relatively flat gems; representations of sports and entertainment figures; stampings of horns; claws; insects; fishing lures; animals; boats; cars, etc. In like fashion, the belt buckle would be capable of displaying an artist's print, a miniature painting, a logo, a photograph, or a political ad. The invention is easily adaptable to ladies designer styles by use of solid or multiple color plates displayed in the window of the front plate.

The belt buckles known in the art are manufactured by a number of processes including stamping, casting or molding, gluing, brazing, crimping, carving, engraving, or silver smithing (art of making articles of silver). Those buckles in the art which have some type of artistic design or impression, are generally of a one-piece construction and do not allow the wearer to display the suggested collector stamps, prints, etc., nor do they permit the interchangeability that is afforded with the proposed invention.

SUMMARY OF THE INVENTION

It is, therefore, an object of the subject invention to provide a construction for a belt buckle that is flexible in nature. The outdoorsman may use the present invention to display at different wearings his entire collection of conservation wildlife stamps. The fashionable woman is able to coordinate her entire wardrobe by color, texture, and style to a given design that can be inserted and removed from the buckle with considerable ease. It is not necessary to purchase a new belt buckle for each desired design, but only to purchase the item for display.

More particularly, it is an object of the subject invention to provide a belt buckle for selectively displaying one or more articles for viewing and permitting the wearer to interchange at will said articles, comprising a frame having a thickness with front and rear surfaces and an opening extending through said thickness from said rear to said front surfaces, said front surface being constructed such that said opening forms a viewing window, and said rear surface being constructed such that said opening forms a cavity greater in size than said window for receiving said display articles which is placed into said cavity in said rear surface to abut the inside of said window in said front surface for said article's retention and viewing, and securing means constructed and arranged to cover the back of said article and to fit flushly into said cavity of said rear surface, and said securing means including fastening means for easily affixing and removing said securing means and said display article into and from said frame.

It is a further object of the subject invention to preserve a stamp, a picture, an artist's print, or any other relatively flat item by sealing same between a clear front viewing plate and a solid backing plate. Thus, the item is protected from wear and tear, dirt, weather, rubbing, and other means of damaging or distorting same.

BRIEF DESCRIPTION OF THE DRAWINGS

These objects, as well as other novel features and advantages of the subject invention, will be better appreciated and understood when the following description is read along with the accompanying drawings, of which.

DETAILED DESCRIPTION OF PREFERRED EMBODIMENTS OF THE SUBJECT INVENTION

Figure 1:
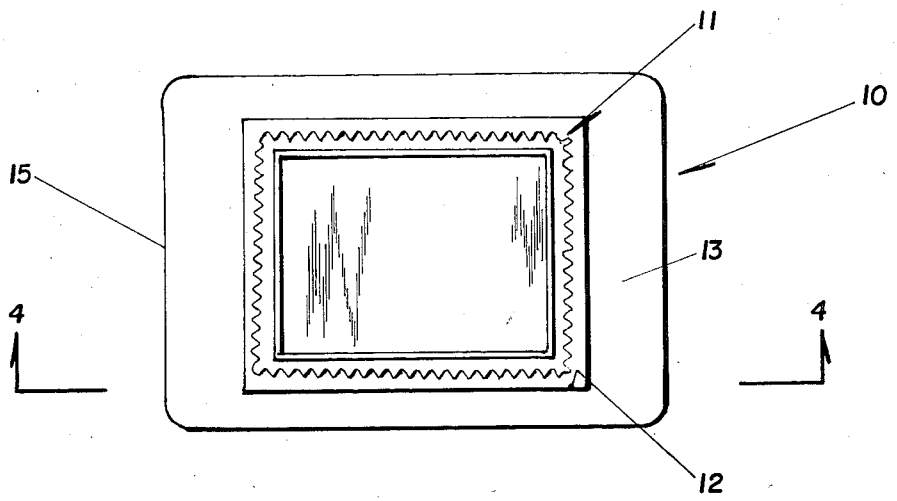
FIG. 1 is a front view of the subject invention in assembled form and contains an item for viewing or display.

FIG. 1, as mentioned above, illustrates the front view of the subject invention in assembled form as would be seen by a person looking at the belt buckle which may be on the wearer of the belt. Front frame 10 is of a rigid construction made of a metal, such as steel, silver, bronze, pewter or gold. Wood, plastic, or any other suitable material may be used instead of metal. Numeral 11 identifies a display assembly (more about which will be explained shortly) and as mentioned herein, may include a stamp, design, figure, photograph, etc. Frame 10 is shown to be rectangular, but its size and shape may be as varied as the designer chooses. Some possibilities for the shape of frame 10 may include an oval, square, hexagon, octagon, or any other suitable designs made to appear like a set of horns, a boat, or other objects. Opening or window 12 of front frame 10 is also shown as being rectangular, but may take a form different than that shown, depending on the intended views or appearances of the item in display assembly 11, i.e. the shape of window 12 may correspond to the shape of the displayed article in display assembly 11.

Figure 2:
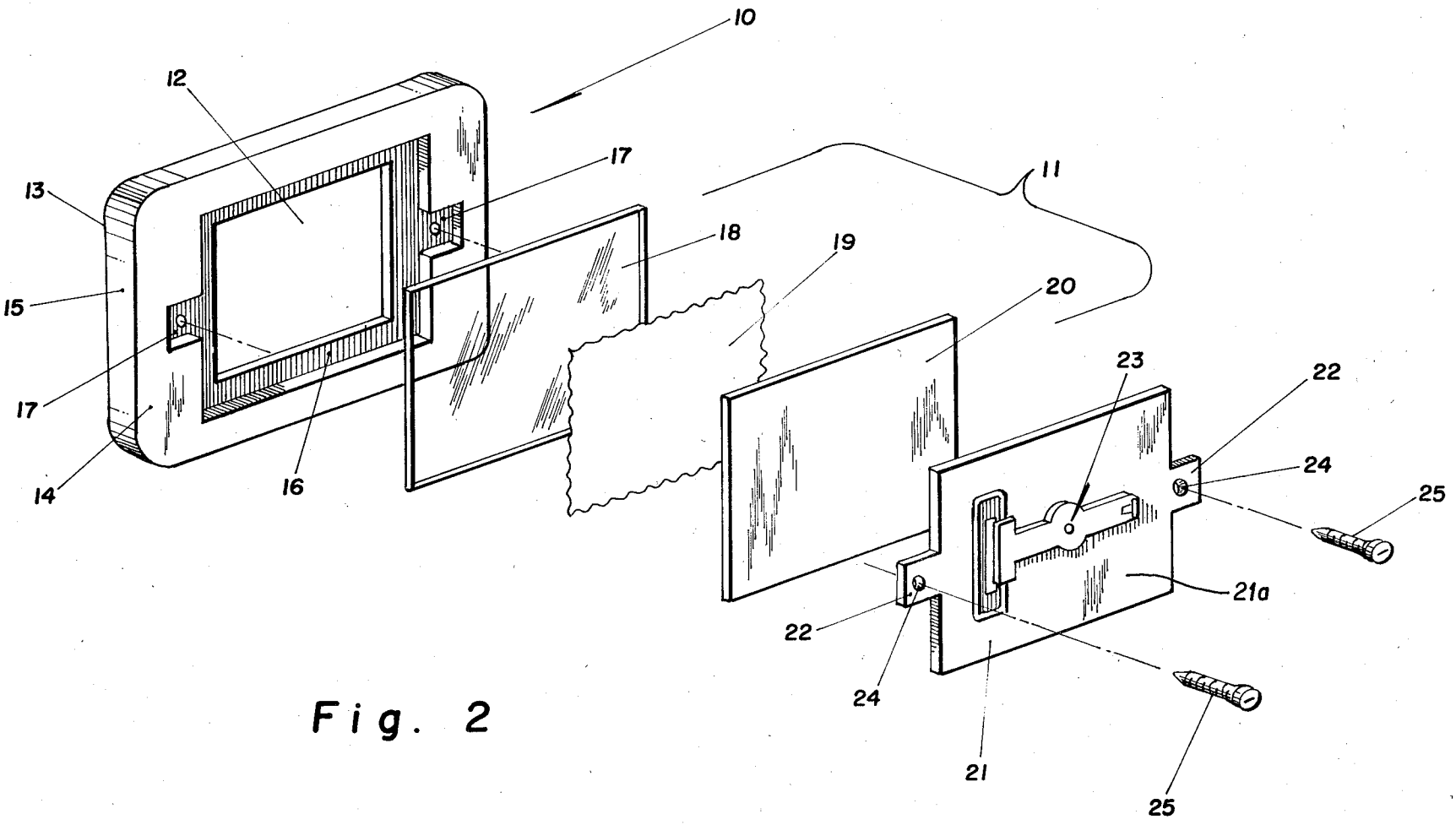
FIG. 2 is a perspective view of the subject invention illustrating the constituent parts in position for the assembling thereof.

FIG. 2 illustrates a perspective view of the components in their respective order for assembly thereof which when placed together and fastened, forms the subject invention. Front frame 10 consists of a front surface 13, a back surface 14, an encompassing edge 15, and a cut-out section or cavity 16 which is recessed from back surface 14 and has opposing recessed slots or wings 17. Cut-out section 16 is designed to receive and retain display assembly 11 consisting of a clear pane 18, an article 19 for display and viewing, and a rear plate sealer 20. It is apparent that the size of display assembly 11 or at least pane 18 is such as to fit into cut-out section 16 without falling through window 12. Display assembly 11 is then enclosed by insertion of rear or back plate covering 21 having a main body **21*a* and wings 22, thereby taking the same configuration as that of cut-out section 16 with its wings 17. Main body 21***a* and wings 22 of back plate 21 have sidewalls corresponding to the sidewalls of cavity 16 and recessed slots 17. Rear plate covering 21 is designed to fit flush with back surface 14, whereby its wings or protrusions 22 are received in slots 17 of frame 10. Openings 24 receive screws 25 to secure clear pane 18, article 19, and rear plate sealer 20 into front frame 10. Both pane 18 and rear plate sealer 20 act as a sealing means for article 19. Buckle assembly 23 is mounted to the outer surface of rear plate covering 21 and as shown, consists of a loop section 26 through which an end of a belt (not shown) is inserted and attached, and arm 27 and hook 28, which hook 28 is placed into the holes of the belt. This buckle assembly 23 may be any of a variety of mechanisms currently on the market for attaching the ends of a belt to the belt buckle of the subject invention.

No matter what form the display article 19 takes, its perimeter or its mounting plate should be relatively flat to fit into the framework of said belt buckle.

Figure 3:
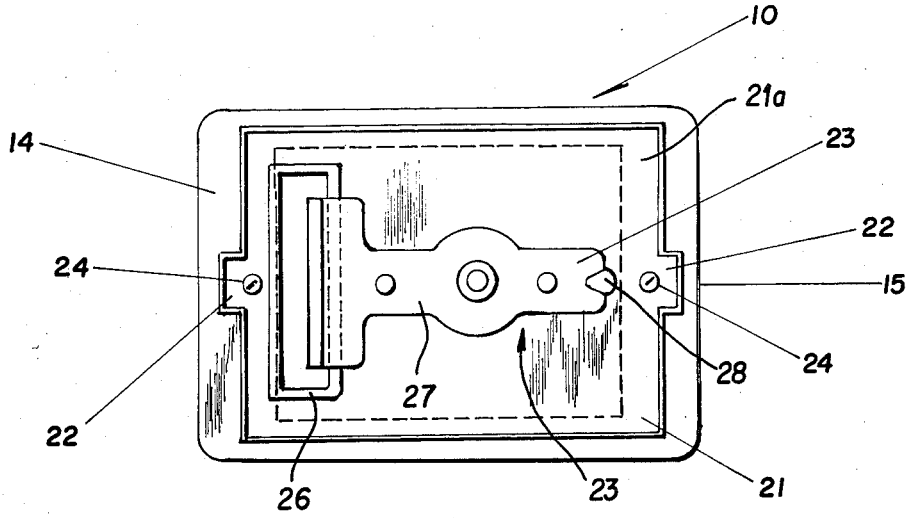
FIG. 3 is a back view of the subject invention in assembled form.
Figure 4:
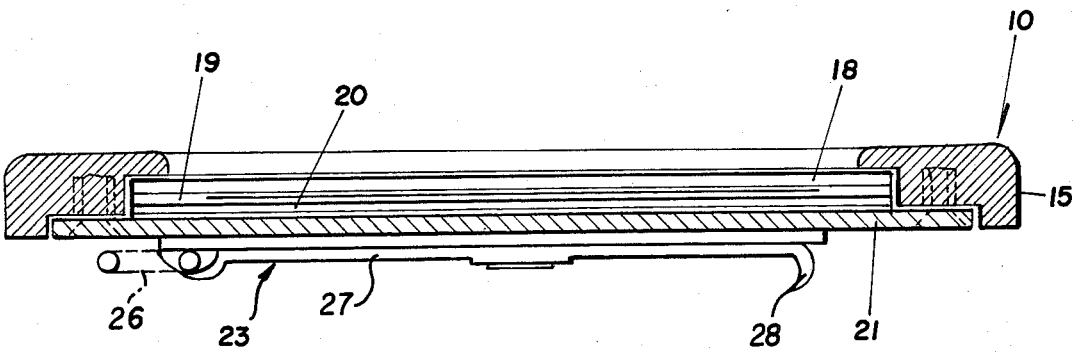
FIG. 4 is a cross-sectional view taken along lines 4—4 of FIG. 1.

As mentioned already, FIG. 3 illustrates the present invention from the back view in assembled form, and FIG. 4 illustrates a cross-sectional view taken along lines 4—4 in FIG. 1. The same components are given the same numbers as those in FIGS. 1 and 2.

Clear pane 18 may be constructed of any transparent material, including but not limited to, acrylic, plastic, glass, etc. The article 19 for viewing, as previously mentioned, may include conservation wildlife stamps, prints, photographs, items carved of various materials, and various designer plates containing a variety of colors and/or materials. Also, clear pane 18 is relatively flat, but may be formed to protrude outwardly to some extent taking the shape of a protruding display item 19.

Rear plate sealer 20 may be constructed of any material that aids in sealing the article for viewing 19 and might include plastic, rubber, paper, particle board, etc.

Display assembly 11, consisting of elements 18, 19, and 20, may be replaced with a one-piece construction such as element 20 where the artistic impression is contained therein.

Rear plate covering 21 and front frame 10 are constructed of the same material which may include those materials already suggested above for front frame 10. Even though screws 25 are shown in the figures, other fastening means such as pins, etc. may be used.

Clear pane 18 shall be used primarily when the wearer desires to seal or retain the article of viewing. It would be optional to omit clear pane 18 if used with a carving or article that does not need protected.

In accordance with the patent statutes, I have explained the principle and operation of my invention, and have illustrated and described what I consider to represent the best embodiment thereof.

I claim:

1. A belt buckle for selectively displaying an article for viewing, which article is in a relatively flat form, and including a buckle assembly for connecting together the ends of a belt, comprising:

a frame having a thickness with front and rear surfaces and an opening extending through said thickness from said rear to said front surfaces, said front surface being constructed such that said opening forms a viewing window, and said rear surface being constructed such that said opening forms a cavity, which cavity is greater in size than said window for receiving said display article which is placed into said cavity in said rear surface to substantially cover said window and be retained in said cavity for its viewing, said rear surface of said frame further constructed such that said opening has laterally opposed recessed slots, each slot communicating with and smaller than said cavity, a relatively flat back plate consisting of a main body with laterally opposed arranged protrusions, each protrusion corresponding to said recessed slots, said main body of said back plate constructed to be received in said cavity to completely cover the back of said article, and said protrusions each constructed to be received in a said different recessed slot in a manner said back plate fits flushly in said opening relative to said rear surface, and fastening means insertable in said protrusions of said back plate and into said frame for securing said back plate and article in said opening in said frame.

2. A belt buckle according to claim 1, wherein said cavity and said slots have sidewalls, and wherein said back plate has sidewalls corresponding to those of said cavity and said slots, said sidewalls being free from any obstructions such that said back plate is easily placed in a relatively flat disposition into said opening from said rear surface and secured therein.

3. A belt buckle according to claim 1, further comprising: sealing means arranged on opposing sides of said display article and constructed in a manner to take the same configuration as said display article and to close said article off from the outside air when said sealing means with said article is assembled inside said buckle between said frame and said back plate.

4. A belt buckle according to claim 3, wherein said sealing means includes a transparent pane placed on one said opposing side of said article for its viewing in said window and a rear plate sealer placed behind said article such that the perimeter of said pane and said sealer are substantially flush with the sides of said cavity in said rear surface of said frame.

* * * * *